US007610644B2

(12) United States Patent
Bringewatt et al.

(10) Patent No.: US 7,610,644 B2
(45) Date of Patent: Nov. 3, 2009

(54) METHOD AND APPARATUS FOR WASHING AND/OR SPIN-DRYING LAUNDRY

(75) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 280 days.

(21) Appl. No.: 11/469,966

(22) Filed: Sep. 5, 2006

(65) Prior Publication Data

US 2007/0068032 A1 Mar. 29, 2007

(30) Foreign Application Priority Data

Sep. 6, 2005 (DE) ..... 10 2005 042 381

(51) Int. Cl.
*D06B 3/34* (2006.01)

(52) U.S. Cl. ..... 8/159; 68/12.04

(58) Field of Classification Search ..... 68/12.04; 8/159

See application file for complete search history.

(56) References Cited

U.S. PATENT DOCUMENTS 4,400,838 A * 8/1983 Steers et al. ..... 8/158
5,768,730 A * 6/1998 Matsumoto et al. ..... 8/159
6,065,170 A * 5/2000 Jang ..... 8/158
6,460,381 B1 * 10/2002 Yoshida et al. ..... 68/12.04
6,983,657 B1 * 1/2006 Kakutani et al. ..... 73/779

FOREIGN PATENT DOCUMENTS

| | | | |
|---|---|---|---|
| DE | 28 44 755 | * | 4/1980 |
| JP | 60-034493 | * | 2/1985 |
| SU | 1647058 | * | 5/1991 |

* cited by examiner

*Primary Examiner*—Frankie L Stinson
(74) *Attorney, Agent, or Firm*—Laurence P. Colton; Smith, Gambrell & Russell, LLP

(57) ABSTRACT

The invention makes provision for the weight of the contents of the drum to be continuously determined. As a result, the weight of the dry laundry in the drum and the weight of the liquid required for washing can be determined. The weight determination also makes it possible to determine the residual moisture content of the laundry, identify an unbalance and/or assist batch division. The spin dryer (10) or laundry centrifuge preferably rests on its feet (19) by means of weight sensors, that is to say is weighed. In this way, the weight of the contents of the drum as well as dynamic forces which are produced when the loaded drum is driven in rotation can be established in a simple and reliable manner.

26 Claims, 2 Drawing Sheets

METHOD AND APPARATUS FOR WASHING AND/OR SPIN-DRYING LAUNDRY

STATEMENT OF RELATED APPLICATIONS

This patent application claims convention priority on German Patent Application No. 10 2005 042 381.7 having a filing date of 6 Sep. 2006.

BACKGROUND OF THE INVENTION

1. Technical Field

The invention relates to a method for washing and/or spin-drying laundry, with the laundry being washed and then spun-dry or only being spun-dry in a drum which is driven in rotation. The invention also relates to an apparatus for washing and/or spin-drying laundry in a spin dryer or laundry centrifuge, having a drum which can be driven in rotation and is mounted on a basic frame which stands on the floor.

2. Prior Art

Apparatuses of the type discussed here, which are usually used in commercial laundries, serve either to wash and spin-dry (spin dryer) or only to spin-dry (laundry centrifuge) laundry. The term laundry does not only mean items of clothing and domestic laundry, but also other articles to be washed, for example mats.

Extensive requirements are placed on spin, dryers and laundry centrifuges. Said spin dryers and laundry centrifuges can only accommodate a specific amount or a specific weight of laundry. Accordingly, for washing purposes, a specific level of liquid has to be present in the drum which is driven in rotation and serves both for washing and spin-drying purposes. In the event of spin-drying, the liquid should be removed from the laundry to such an extent that said laundry contains only a specific amount of residual moisture. In addition, spin-drying is performed at customarily high rotational speeds, which is why the unbalance of the drum, which is loaded with the laundry and the liquid bound therein (bound liquor), must not exceed certain limits. Finally, a washing centrifuge, but also a spin dryer, is followed by at least one dryer, with the capacity of the respective dryer and also the cycle time of the latter differing from that of the spin dryer and the laundry centrifuge. In cases such as this, the laundry leaving the spin dryer or the laundry centrifuge is usually divided into at least two batches of preferably equal size (batch division). Known spin dryers and laundry centrifuges do not fully satisfy said requirements—if at all.

BRIEF SUMMARY OF THE INVENTION

The invention is based on the object of providing a method and apparatus for washing and/or spin-drying laundry which, in a simple manner, operate economically while maintaining the machine-specific requirements.

One method for achieving this object is a method for washing and/or spin-drying laundry, with the laundry being washed and then spun-dry or only being spun-dry in a drum which is driven in rotation, wherein the weight at least of the contents of the drum are determined. According to this, provision is made for the weight at least of the contents of the drum to be determined. According to the invention, this is done in a simple manner by weighing at least the drum, including its contents. The weight of the still dry laundry in the drum, the weight of the laundry together with the liquid in the drum, and the weight of the laundry together with the liquid contained therein, the so-called bound liquor, can predominantly be determined solely by means of a weighing operation such as this. In this way, it is possible to draw conclusions about the loading state of the drum at the time of the weighing operation or the weight determination. The loading state can be established in a simple manner on account of the at least one weight measurement and permits various conclusions to be drawn about optimum loading of the drum and about washing and/or spin-drying of the laundry and possibly also loading and unloading of the drum. The result of the weighing operation can be used predominantly for a plurality of possibly different purposes.

The weight of the laundry and possibly the liquid in the drum is preferably measured two or more times. The weight is expediently measured continuously. Continuous weight determination of this type is to be understood to be constant, continuous weight determination or alternatively weight determination in successive, preferably regular, time intervals. It is therefore possible to establish the magnitude of the actual weight of the laundry and possibly liquid in the drum at the time of the respective weight measurement. It is therefore also possible to establish changes in weight over time in a simple manner. During loading and unloading of the drum, but also during washing and/or spin-drying, the weight of the contents of the drum can be determined continuously. As a result, data which is required for operation of the spin dryer or laundry centrifuge can be determined before, during or after the washing and/or spin-drying treatment of the laundry. This data can be determined in a particularly simple manner because it is only necessary to measure the weight of the drum together with its contents.

In one preferred method, the weight of substantially the entire spin dryer or laundry centrifuge is determined, to be precise preferably two or more times, in particular continuously. Therefore, not only the weight of the drum together with its entire contents, but also the weight at least of the essential parts of the basic framework which bears the drum is established. Since the weight of the drum and the basic frame does not change because it is constant, the weight of the mass of the contents of the drum can be determined in a reliable manner on the basis of the known weight of the drum and the basic frame, specifically at least the parts of the latter included in the weight measurement, by subtracting said weight of the drum and basic frame from the measured total weight. It is therefore possible to establish the mass or the weight of the laundry and possibly the liquid in the drum in all operating states of the spin dryer or laundry centrifuge.

According to one refinement of the method, only the weight of the laundry, in particular the still dry laundry, is determined during loading of the drum and/or when the process of loading the drum is terminated. This therefore allows the weight of the laundry which is located in the drum at that moment to always be established. The loading process can be terminated at the appropriate time when the weight determination shows that the drum contains laundry which is at the intended weight. Since the weight measurement is expediently performed continuously (uninterrupted or at regular time intervals), the loading process can be stopped in a simple manner as soon as the weight determination shows that the drum contains laundry which is at the intended or prespecified weight.

Particularly in the case of a spin dryer, it is possible to establish how much liquid is located in the drum in addition to the laundry by determining the weight of the contents of the drum. It is thus possible to draw conclusions about the liquid level (height of the level of the liquid) in the drum by taking account of the given dimensions of the drum. Filling of the drum with the required amount of liquid can mainly be monitored in this way. The addition of liquid to the laundry is stopped when the determined weight of the total contents of the drum allow conclusions to be drawn about a specific liquid level which is preferably matched or adapted to the previously determined specific weight of the laundry in the drum.

In terms of the method, provision is also made for the residual moisture contained in the laundry to be established during spin-drying of the laundry by weight being determined preferably continuously (uninterrupted or at regular time intervals). In this case, it is assumed that liquid is removed and diverted away from the laundry during spin-drying. As a result, the weight of the contents of the drum, that is to say the laundry together with the liquor bound therein, decreases as the spin-drying time increases. Since the weight of the drum comprising dry laundry was determined during loading, it is possible to establish the level of the proportion of thee residual moisture content of the laundry by comparing the result of the weight measurements of the drum loaded with dry laundry and laundry which is spun-dry and still contains bound liquor. The point at which a specific residual moisture content is reached in the laundry is expediently established, so that the spin-drying process can then be deliberately terminated, to be precise as a function of knowledge which was obtained from different weight measurements.

According to one preferred refinement of the method, temporal or periodic changes in weight, which are produced by dynamic forces on the drum which is driven in rotation, are determined by the weight being measured over a corresponding period of time. The dynamic changes in weight are predominantly determined by constant, uninterrupted and therefore continuous weight measurements or weight measurements which are carried out over a specific period of time at regular time intervals, that is to say interrupted by breaks of preferably equal length. These dynamic or periodic changes in weight provide information about an unbalance of the drum which is driven in rotation. Since the drum is balanced, that is to say does not have an unbalance in the unloaded state, established changes in weight can lead to an unbalance when the drum is loaded with the laundry. An unbalance of this type normally only occurs when the laundry is not—as is normally customary—distributed substantially uniformly over the inner circumference of the drum when the drum is rotating.

If the unbalance of the drum with the laundry contained therein, which unbalance is established during the continuous weight measurement, reaches a specific value, for example a prespecified limit value, provision is made to no longer increase the rotational speed of the drum, particularly for spin-drying the laundry. The laundry is then spun-dry at below the maximum rotational speed. The spin-drying process is then maintained over a relatively long period of time until the maximum residual moisture content of the laundry, which is likewise established in accordance with the inventive method, is reached.

It is also possible to establish an unbalance as early as when rotation of the drum is started, on the basis of the weight measurements which are performed over a certain period of time. This suggests that the laundry in the interior of the drum is bunched up and not—as is normally the case—distributed largely uniformly over the circumference of the drum. If an unbalance is established as early as when the drum is started, driving is interrupted and the drum is braked, preferably until it is at a standstill. This generally leads to the bunch of laundry being broken up. Driving is then restarted until an initial unusually high unbalance is no longer established.

Provision is also made for the weight of the laundry, together with the remaining liquor (residual moisture) still bound therein, to be determined before the drum is unloaded, and also for the weight of the laundry which still remains in the drum, together with the still bound liquor, to be determined continuously (permanently or at regular time intervals) during unloading. As a result, the proportion of laundry, together with the remaining liquor still bound therein, which is unloaded is always known. It is possible to unload the laundry in batches by comparing the weight of all of the laundry, together with the remaining bound liquor in the drum, with the weight of the laundry, together with the remaining bound liquor, which is still located in the drum at that moment during the unloading process, it being possible to deliberately form batches with a specific laundry weight. If the laundry is to be unloaded from the drum, for example, in two batches which are usually of the same size, unloading of the drum is stopped when the weight determination shows that the weight of the remaining contents of the drum corresponds to approximately half the weight of the contents of the drum following conclusion of the spin-drying process. The weights are correspondingly quantized in the case of a plurality of batches of equal weight. It is also feasible to form batches of different size. The individual batches are formed by the unloading process being interrupted for a specific period, after which an amount of laundry, together with the remaining liquor bound therein, which amount forms a batch with a specific weight, was unloaded from the drum.

An apparatus for achieving the object mentioned in the introduction is an apparatus for spin-drying laundry in a spin dryer or laundry centrifuge, having a drum which can be driven in rotation and is mounted on a basic frame which stands on the floor, wherein at least one weight sensor is associated with the basic frame. Provision is accordingly made for the basic frame which bears the drum to have at least one associated weight sensor. As a result, the apparatus is, to all intents and purposes, weighed. The at least one weight sensor serves to indirectly measure the weight of the contents of the drum by determining the total weight of the drum together with its contents, in particular laundry and/or liquid, and at least some of the weight of the basic frame. Since the weight of the basic frame and the drum, which weight is entirely or partly taken into account during the measurement, is known and does not change to any appreciable extent, the result of the weight measurement allows conclusions to be drawn about the weight of the contents of the drum, that is to say the weight of the laundry and possibly liquid which are contained in said drum.

A weight sensor normally suffices for reliably determining the weight of the laundry and/or the liquid contained in the drum. In subsequent weight measurements, a single weight sensor also suffices for determining periodic changes in weight and/or dynamic force, in particular an unbalance.

The at least one weight sensor is preferably arranged in the vicinity of a foot which is used to support the basic frame on the floor and/or is associated with this foot. The at least one weight sensor is preferably arranged in the basic frame, preferably above the foot on which the weight sensor which bears the basic frame and the drum is supported. As a result, the weight sensor is protected by the basic frame.

The basic frame and the drum are supported on the at least one weight sensor, with this weight sensor in turn being supported on its associated foot. The at least one weight sensor thus determines the weight of the basic frame comprising the drum, including the contents of the drum, that is to say the force with which the apparatus is supported on its foot which is associated with the weight sensor at that instant, that is to say at the time of the weight measurement. The apparatus is therefore virtually weighed, to be precise a number of times or constantly, depending on requirements.

In one preferred apparatus, each foot of the basic frame has an associated weight sensor. These are preferably identical weight sensors in this case.

The plurality of weight sensors mean particularly precise weight measurement is possible. In addition, the weight measurement can also be carried out if one weight sensor fails. However, the main thing is that the dynamic forces and periodically changing weights can thus be established more reliably and more precisely, in order to determine, for example, the unbalance of the drum which is driven in rotation. The weight of the laundry and possibly also the liquid or residual moisture can be reliably determined even when the drum is driven in rotation, without the rotation of the drum influencing or corrupting the weight determination.

Suitable weight sensors include all the known designs, for example pressure pickup cells, piezoelements, strain gauges, spring carriages or the like. The weight sensors are preferably in the form of load cells. For example, shear beam load cells are used which operate in accordance with the 6-wire technique with measurement amplifiers and have a weighing range of up to 5 t.

BRIEF DESCRIPTION OF THE DRAWINGS

One preferred exemplary embodiment of the invention is explained in greater detail below with reference to the drawings, in which.

DETAILED DESCRIPTION OF THE PREFERRED EMBODIMENTS

Figure 1:
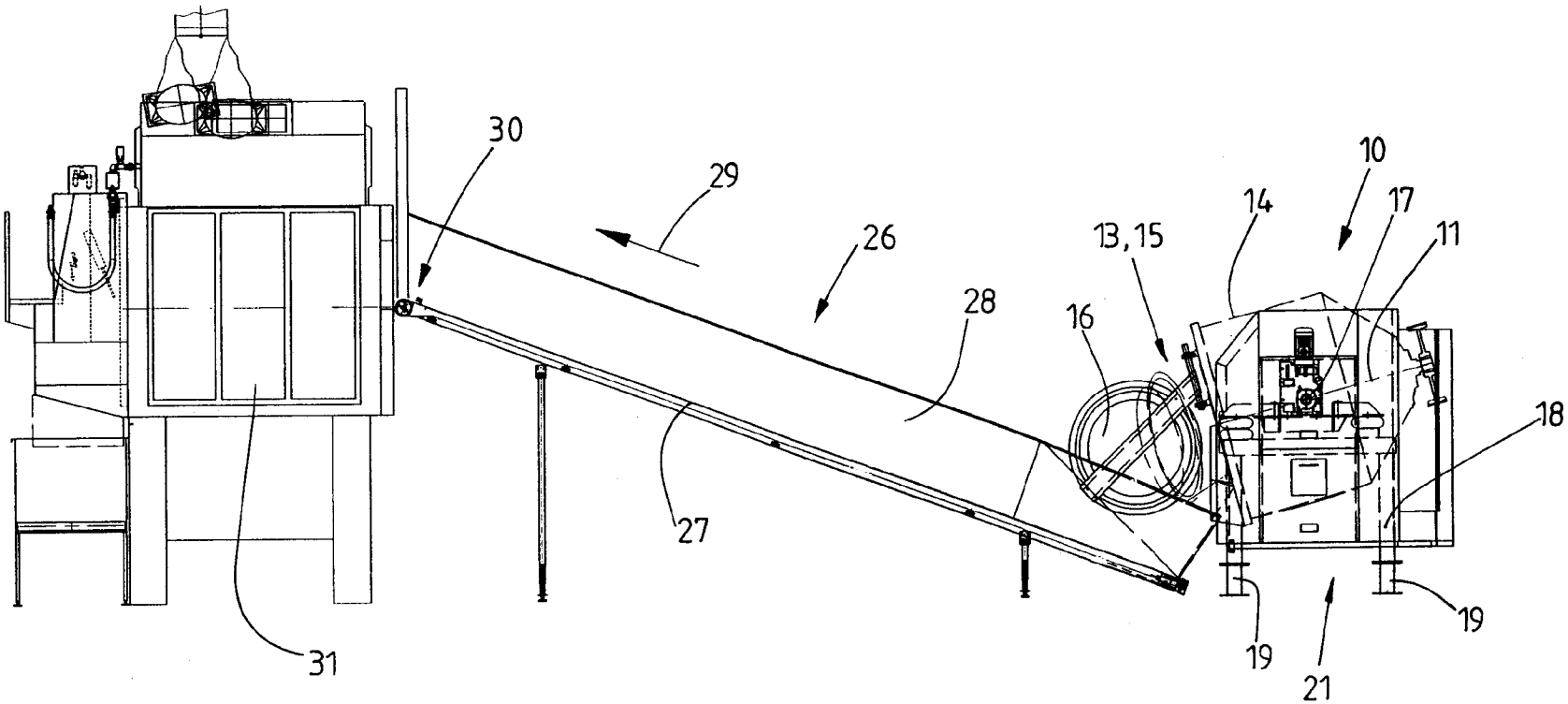
FIG. 1 shows a basic side view of the apparatus together with a downstream unloading belt and a dryer which can be loaded by said belt.

The figures show an apparatus which is in the form of a spin dryer 10 for use in commercial laundries in particular.

The spin dryer 10 has a drum 12 which can be driven in rotation about a pivotable axis of rotation 11, and liquid can pass through said drum through at least partial perforations in its casing surface. The free end face of the drum 12 has a single opening 13 which takes up substantially the entire face.

The spin dryer 10 also has a water-tight drum housing 14 which surrounds the water-permeable drum 12. The drum housing 14 is formed such that it is stationary in relation to the drum 12, that is to say, in contrast to the drum 12, cannot be driven in rotation. A free end face of the drum housing 14 also has a single opening 15 which takes up virtually the entire face. The opening 15 is associated with that end face of the drum housing 14 toward which the opening 13 in the drum 12 also points. The openings 13 and 15 are therefore situated adjacent to one another since they correspond to one another. In the spin dryer 10 shown here, the opening 15 in the drum housing 14 can be closed by a pivotable door 16.

The drum housing 14 comprising the drum 12, which is rotatably mounted therein, can be pivoted about a pivot axis 17 which runs transverse to the axis of rotation 11 of the drum 12. The pivot axis 17 runs horizontally, so that, for loading and unloading purposes, the drum 12 together with the drum housing 14 can be pivoted such that the openings 13 and 15 point upward in an at least slightly inclined manner (loading position) or are directed obliquely downward (unloading position). In order to operate the spin dryer 10, the drum 12 together with the drum housing 14 can be pivoted into a washing position in which the axis of rotation 11 of the drum 12 runs horizontally, inclined or else perpendicular.

The drum housing 14 is mounted on a basic frame 18 of the spin dryer 10 by the pivot axis 17. In the spin dryer 10 shown, four preferably identical feet 19 are arranged on a lower face 21 of the basic frame 18. The spin dryer 10 stands on the floor of a laundry by means of the feet 19.

Details regarding mounting of the drum housing 14 on the basic frame 18 and the drives for pivoting the drum housing 14 with respect to the basic frame 18 and for driving the drum 12 in rotation are known per se, for example from (German Patent Application No.) DE 103, 43 306 A1 in connection with a laundry centrifuge, and from (German Patent Application No.) DE 10 2004 002 585 A1 in connection with a spin dryer. In this respect, reference is made to these documents.

The spin dryer 10 shown here is provided with at least one weight sensor 20. As a result, the spin dryer 10 is weighed. The weight of the contents of the drum 12 at that moment can be determined on account of this weighing operation. Changes in the weight of the dry or still wet laundry over time, as occur during unloading for example, can be established by means of a plurality of weight measurements which follow one another at regular time intervals or by means of continuous uninterrupted weight measurements. However, dynamic forces which occur when the drum 12, in particular the loaded drum 12, is driven in rotation can therefore be determined. The at least one weight sensor 20 is preferably associated with the basic frame 18. The weight sensor 20 is preferably arranged in the region of the lower face 21 of the basic frame 18, to be precise between the basic frame 18 and the respective foot 19 in this case.

Figure 2:
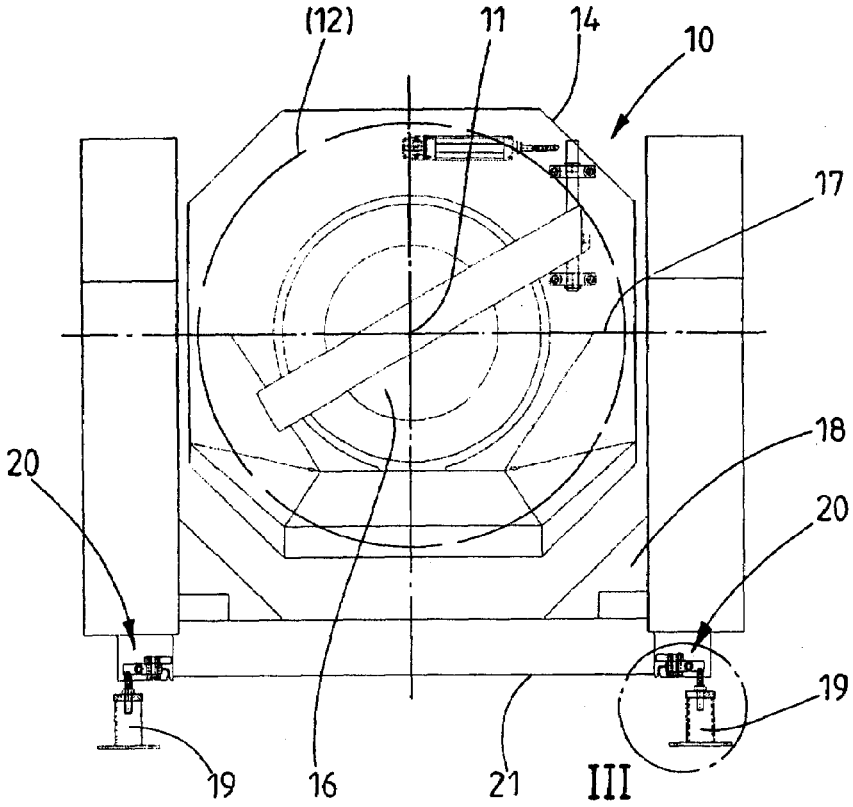
FIG. 2 shows a front view of the apparatus from FIG. 1.
Figure 3:
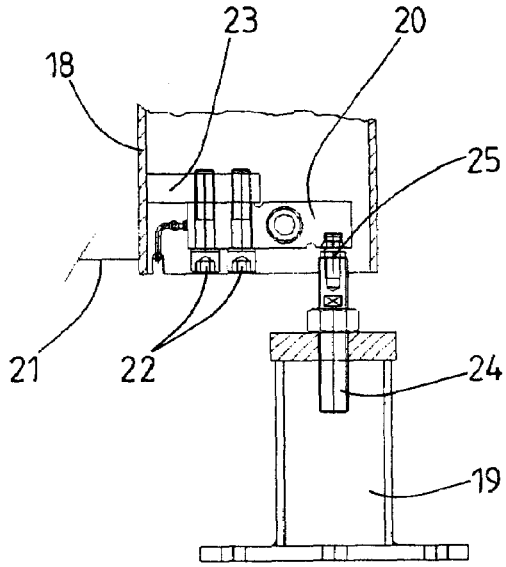
FIG. 3 shows an enlarged detail III from FIG. 2, in the region of a foot of a basic frame of the apparatus.

Four weight sensors 20 are provided in the exemplary embodiment shown. These sensors are identical weight sensors 20. The weight sensors 20 are installed in a lower region of the basic frame 18, to be precise such that one weight sensor 20 is supported on each of the four feet 10 (FIGS. 2 and 3). The figures show that the weight sensors 20 are arranged within the outline of the basic frame 18, to be precise in the vicinity of the lower face 21 of the basic frame 18. As a result, the weight sensors 20 are positioned such that they are protected in the interior of the basic frame 18 which is hollow in the region of the weight sensors 20, particularly when the spin dryer 10 is transported. It is therefore also possible for the weight sensors 20 to be associated with the feet 19 by each of the four weight sensors 20 being supported on one of the likewise four feet 19 (FIG. 3). The weight sensors 20 which are firmly connected to the basic frame 18 in the lower region are subjected to almost the entire weight of the spin dryer 10, specifically of the basic frame 18, the drum housing 14 and the drum 12 together with its contents.

Provision is preferably made for the casing and the at least one switchgear cabinet to be separate from the basic frame 18. As a result, interfering influences which could affect the result of the measurement of the weight sensors 20 are avoided, to be precise just like flexible media supply lines.

In the spin dryer 10 shown here, each weight sensor 20 is in the form of a shear beam load cell. The shear beam load cell has a corresponding measuring range depending on the size of the spin dryer 10. A shear bean load cell which can determine weights of up to 5 t is generally sufficient. Each of the shear beam load cells is preferably formed in accordance with the 6-wire technique and provided with a measurement amplifier. However, it is also feasible to provide one measurement amplifier for all four weight sensors 20, specifically shear beam load cells. Customary measurement, evaluation and display electronics are provided downstream of the measurement amplifier or amplifiers. Provision is expediently also made of a computer which processes, calculates and possibly also stores the measurement signals from the weight sensors 20. The latter is particularly expedient when, according to one preferred exemplary embodiment of the invention, the weight sensors 20 supply successive measurement signals, to be precise at uninterrupted intervals or with a time interval, with the breaks between successive measurements expediently being of equal length in the last-mentioned case.

The shear beam load cells are firmly connected to the basic frame 18 at one end. In the exemplary embodiment shown, approximately half of each shear beam load cell is screwed by a plurality of screws 22 to a crossbeam 23 which is firmly connected to the basic frame 18. The resulting releasable connection between the shear beam load cell and the basic frame 18 is made such that the elongate shear beam is located in the basic frame 18 in a horizontally directed manner, with a second half of the elongate shear beam load cell protruding in a freely projecting manner with respect to the horizontal crossbeam 23 of the basic frame 18 (FIG. 3). An outer end region of the lower face of that part of the shear beam load cell which protrudes freely with respect to the crossbeam 23 of the basic frame 18 rests on the respective foot 19. To this end, each foot 19 has a threaded rod 24 or else a screw. The threaded rod 24 is screwed into the foot 19 and is brought into contact with the projecting free end 25 of the shear beam load cell (weight sensor 20) by an upper free end 25. The end 25 of the threaded rod 24 may possibly be secured in a corresponding recess in the shear beam load cell, for example by being tightly screwed. In order to horizontally orient the spin dryer 10, the threaded part 24 is screwed into the foot 19 to a greater or lesser extent, so that the free end 25 of the threaded rod 24 is at a corresponding distance from the upper race of the foot 19.

FIG. 1 shows that the spin dryer 10 has an associated unloading belt 26 on the unloading side. In the simplest case, said unloading belt is a conveyor belt. Opposite sides of the upper strand 27 of the unloading belt 26 preferably have associated stationary guide walls 28, as a result of which the unloading belt 26 is in the form of a channel for laterally guiding the laundry which is transported further on the unloading belt 26. The unloading belt 26 shown here rises slightly in the conveying direction 29. However, the unloading belt 26 may also run horizontally or in a slightly inclined manner. A dryer 31 is associated with the end 30 of the unloading belt 26. In this way, the laundry can be transported from the spin dryer 10 to the dryer 31 by means of the unloading belt 26, in order to load the dryer 31 with the laundry arriving from the spin dryer 10.

The inventive method will be explained in greater detail below with reference to the spin dryer 10 described above:

The weight sensors 20 continuously, to be precise either in an uninterrupted sequence or at regular time intervals which follow one another with specific, preferably equal, breaks, determine the weight of that part of the spin dryer 10 which rests on the feet 19 and therefore on the weight sensors 20 which are arranged between the spin dryer 10 and the feet 19. In the process, the drum 12 together with its contents, the drum housing 14, the basic frame 18 and the parts which are associated with said components of the spin dryer 10, in particular drives, are weighed continuously or from time to time. Since this weight, apart from dynamic forces, is always constant, the weight of the contents of the drum 12 can be determined by subtracting the empty weight of the components of the spin dryer 10 which rest on the weight sensor 20.

The weight of the contents of the drum 12 can be determined by the weight sensors 20 even when the drum 12 is driven in rotation if dynamic forces, which are possibly produced by the loaded drum 12 being driven, are added. Since the dynamic forces are of a periodic nature and weight is measured continuously over time, the dynamic forces lead alternately to an increase and a reduction in the weight of the spin dryer 10, including the contents of the drum 12, determined by the weight sensors 20 at the time of the weight determination. An average value of the periodically fluctuating weight measurement values leads to the weight of the contents of the drum 12 being determined without taking dynamic force components into account. The magnitude of the deviations of the weight forces from the average value, as detected by the weight sensors 20, allows conclusions to be drawn about the dynamic forces, to be precise particularly unbalances when the loaded drum 12 is driven in rotation. The inventive method therefore allows the weight forces of the contents of the drum 12 to be determined both when the drum 12 is stationary and when it is driven in rotation. Furthermore, the dynamic forces which are produced by possible unbalances when the drum 12 is driven in rotation can be determined by means of the weight sensors 20 by the evaluation electronics which are associated with said sensors.

According to the inventive method, the weight of the drum 12 is first determined during loading. In this way, it is possible to constantly establish the magnitude of the weight of the drive laundry which is located in the drum 12 at that moment. In particular, the weight is determined following conclusion of the loading of the total weight of the batch of dry laundry in the drum 12. The measurement of the weight of the dry laundry during loading of the drum 12 can also be used to terminate the loading process when the drum 12 is loaded with the intended amount of dry laundry. To this end, the desired weight or maximum weight of the dry laundry with which the spin dryer 10 is to be loaded for each working cycle is constantly monitored in the evaluation electronics. The loading process is automatically terminated as soon as the continuous weight measurement establishes that the drum 12 with the dry laundry contained therein has reached the desired or maximum weight.

After the drum 12 is loaded with the dry laundry, liquid, in particular washing water or washing assistant, is filled into the drum 12. The weight is measured continuously in this case too, as a result of which the weight of the liquid (water or possibly washing assistant) which is filled into the drum 12 is constantly determined. The desired weight of liquid, which is required for the amount of laundry which is located in the drum 12, is again entered in the evaluation electronics in this case too. The supply of liquid to the drum 12 is stopped as soon as the desired weight of liquid is reached. The weight measurement ensures that the liquid in the drum 12 is at a sufficient level for washing the amount of laundry present therein. In this way, only inaccurately operating level measurements can be omitted within the drum 12.

Furthermore, the method according to the invention makes provision for the weight of the parts of the spin dryer 10 which rest on the weight sensors 20, and therefore also the weight of the laundry and liquid contained in the drum 12, to in each case be continuously determined by weighing during the spin-drying process which follows washing of the laundry. The determined weight decreases as the spin-drying time increases because spin-drying removes more and more liquid, specifically bound liquor. A desired weight, which corresponds to the weight of the dry laundry initially placed in the drum 12 plus a residual moisture content or bound residual liquor which can or should still be present in the laundry at the end of the spin-drying process, is entered into the evaluation electronics. As soon as the prespecified desired weight at which the laundry contains only the intended residual moisture is reached, the spin-drying process is stopped by the control means which is associated with the evaluation electronics or corresponds to the latter. The laundry can then be unloaded from the spin dryer 10.

In many cases, the dryer 31 which is downstream of the spin dryer receives only part of the batch of laundry from the spin dryer 10. In the text which follows, it is assumed that the dryer 31 receives only half of the batch of laundry from the spin dryer 10. However, the time required by the dryer 31 to dry the laundry, specifically to remove at least the majority of the residual moisture from the laundry, is less than the cycle time of the spin dryer 10, that is to say the time which said spin dryer requires to wash and spin-dry the laundry. In the text which follows, it is assumed that the cycle time of the dryer 31 corresponds only to half the cycle time of the spin dryer 10.

So-called batch division is customarily carried out on account of the different capacities and cycle durations of the spin dryer 10 and the dryer 31. To this end, the batch of laundry in the spin dryer 10 is divided when it is unloaded. In the case adopted here, where the capacity of the dryer 31 is half that of the spin dryer 10, the batch leaving the spin dryer 10 is divided into two partial batches of equal size, specifically batch halves. If the dryer 31 can accommodate only half the items of laundry that the spin dryer 10 can, uniform batch division is performed. This batch division is assisted by the weight of the essential parts of the spin dryer 10, including the laundry in the drum 12 which has a specific residual moisture content, which rest on the weight sensors 20 being established continuously. The weight of the entire batch of laundry, which still contains residual moisture and is located in the drum 12, at and before the beginning of unloading is known on account of the known weight of the components of the spin dryer 10 which rest on the weight sensors 20.

When the batch is divided into two partial batches of approximately equal size and/or equal weight, the spin dryer 10 is gradually unloaded, with the laundry which is being unloaded and contains residual moisture being passed onto the unloading belt 26. It is possible to determine when half the amount of the laundry which still contains residual moisture has left the drum 12 of the spin dryer 10 on account of the constant weight measurement. A partial batch which corresponds approximately to half the weight of the batch of laundry in the spin dryer 10 is then located on the unloading belt 26. The unloading process of the spin dryer 10 is then briefly interrupted. During this time, the first partial batch is transported to the dryer 31 by the unloading belt 26, and the dryer 31 is thus loaded or the partial batch is only transported somewhat further in the direction of the dryer 31 by the unloading belt 26. The drying process of the first partial batch can now begin in the dryer 31. The rest of the laundry which still contains residual moisture is then unloaded from the drum 12 of the spin dryer 10. This remaining laundry corresponds to the second partial batch of approximately the same weight as the first partial batch. This partial batch remains on the unloading belt 26 until the first partial batch is dry. The second partial batch is then transported toward or into the dryer 31 by the unloading belt 26, in order to load the dryer 31 with the second partial batch.

The dynamic forces, which originate particularly from the loaded drum 12 which is driven in rotation and are determined in accordance with the inventive method, can generally be produced only by an unbalance which is the result of non-uniform distribution of the laundry in the drum 12. The signals which are generated by the weight sensors 20 in the event of periodically changing forces accordingly allow conclusions to be drawn about an unbalance of the loaded drum 12 which is driven in rotation.

The dynamic forces which are generated by the loaded drum 12 are measured starting from the beginning of rotation of the drum 12 and preferably also during the entire period of rotation of the latter. This measurement can be terminated when the drum 12 reaches a constant final rotational speed; it is also feasible to perform the measurement continuously during the entire period of rotation of the drum 12, albeit at preferably regular time intervals, that is to say with breaks between individual measurements.

If it is established as early as when the drum 12 starts to move, that is to say when the drum is driven at a low rotational speed, that dynamic forces which exceed a specific limit value prevail, this suggests that there is an unbalance which is above a permissible value. If it is found that the unbalance is higher than the prespecified maximum unbalance when the drum 12 is initially accelerated, for example at the time of a defined low initial rotational speed, this suggests that the laundry in the drum 12 is not uniformly distributed, specifically at least one pile or bunch of laundry has formed. Driving of the drum 12 is then interrupted and the drum 12 is preferably braked until it is at a standstill. As a result, the laundry in the interior of the drum 12 again collapses back on itself. Driving of the drum 12 is then restarted, it then being possible to assume that there is no longer any appreciable unbalance because restarting rotation of the drum 12 has broken up the at least one bunch of laundry and as a result the laundry is substantially uniformly distributed over the circumference of the jacket of the drum 12.

Even if the laundry is distributed over this circumference of the jacket when the drum 12 is accelerated, this is generally not so uniform that there is no unbalance of the drum 12, particularly in the relatively high rotational speed range of the drum 12. Therefore, measurement of dynamic forces by weight determination, that is to say establishing dynamic weight forces, is also continued during further operation, in particular when the drum 12 is accelerated up to the maximum rotational speed. In this way, it is possible to establish whether, and if so when, the drum 12 reaches a defined limit value for the unbalance as the rotational speed increases. As soon as said limit value is reached, the drum 12 is not accelerated any further and as a result the spin-drying process of the laundry is carried out at the highest possible rotational speed at which a prespecified unbalance is not exceeded. In this method, it is possible to always drive the drum 12 at the highest possible rotational speed in order to be able to remove water to the required or prespecified extent as quickly as possible.

The spin dryer 10 can be operated with all of the above-described inventive methods or make use of all of the described method steps for which only weight determinations are necessary, and the weight determinations serve mainly for a plurality of purposes. However, it is also feasible to implement only some of the above-described inventive methods or method steps in a spin dryer 10.

The invention is also suitable for laundry centrifuges which serve only to remove water, specifically to spin-dry, laundry which has previously been washed in a washing machine. A washing centrifuge of this type also has associated weight sensors in the region of the lower face of the basic frame, these weight sensors being supported on feet of the laundry centrifuge. The weight sensors can be formed and mounted in exactly the same way as is the case in FIGS. 2 and 3 in connection with the above-described spin dryer 10, especially since the design of a laundry centrifuge corresponds, in principle, to the spin dryer 10. However, since only a large proportion of the bound liquor is removed from the laundry in a laundry centrifuge, the weight of the laundry with the bound liquor is determined when the laundry centrifuge is loaded.

Since no liquid is added in the case of laundry centrifuges, level measurement, which is described above in connection with the spin dryer 10, by determining the weight of the added liquid is not carried out in the case of said laundry centrifuges.

All of the other inventive methods and method steps which are described in connection with the spin dryer 10 are also carried out in the laundry centrifuge in the same or at least in an analogous manner. In this respect, reference is made to the methods described above in connection with the spin dryer 10, which methods also apply to the laundry centrifuge.

LIST OF REFERENCE SYMBOLS

| | |
|---|---|
| 10 | Spin dryer |
| 11 | Axis of rotation |
| 12 | Drum |
| 13 | Opening |
| 14 | Drum housing |
| 15 | Opening |
| 16 | Door |
| 17 | Pivot axis |
| 18 | Basic frame |
| 19 | Foot |
| 20 | Weight sensor |
| 21 | Lower face |
| 22 | Screw |
| 23 | Crossbeam |
| 24 | Threaded rod |
| 25 | End |
| 26 | Unloading belt |
| 27 | Upper strand |
| 28 | Guide wall |
| 29 | Conveying direction |
| 30 | End |
| 31 | Dryer |

What is claimed is:

1. A method for washing and/or spin-drying laundry, with the laundry being washed and then spun-dry or only being spun-dry in a drum (12) which is driven in rotation, wherein the weight of at least of the contents of the drum (12) are determined, the weight of the laundry, together with remaining liquor which is still bound in the laundry, is determined before and during unloading of the drum (12), and the weight of the laundry still remaining in the drum (12) together with the rest of the bound liquor, which weight is determined during unloading of the drum (12), is used to form partial batches with a specific amount of laundry.

2. The method as claimed in claim 1, wherein the weight of at least of the laundry in the drum (12) is determined by weighing.

3. The method as claimed in claim 2, wherein the weight of the liquid in the drum (12) is determined by weighing.

4. The method as claimed in claim 3, wherein the weight is determined two or more times.

5. The method as claimed in claim 2, wherein the weight is determined two or more times.

6. The method as claimed in claim 1, wherein the weight is determined two or more times.

7. The method as claimed in claim 1, wherein at least almost the entire spin dryer (10) for washing and spin-drying the laundry or at least almost the entire laundry centrifuge for spin-drying the laundry is weighed together with the laundry and the liquid contained in the drum (12).

8. The method as claimed in claim 1, wherein only the weight of the laundry is determined during loading of the drum (12).

9. The method as claimed in claim 8, wherein loading of the drum (12) with the intended amount of laundry is checked by determining the weight of the laundry which is contained in the drum (12) at that moment.

10. The method as claimed in claim 1, wherein the required amount of liquid is established by measuring the weight of the liquid and the laundry in the drum (12).

11. The method as claimed in claim 10, wherein continuous weight measurements establish when a sufficient amount of liquid is present in the drum (12) in relation to the weight of the dry laundry in the drum (12).

12. The method as claimed in claim 1, wherein the residual moisture contained in the laundry is established during spin-drying of the laundry by continuously determining the weight of the laundry and the liquid which is still bound therein.

13. The method as claimed in claim 1, wherein the dynamic forces caused by changes in weight over time are determined by continuous weight measurements over at least one specific time period.

14. The method as claimed in claim 13, wherein an unbalance of the loaded drum (12) when it is driven in rotation is determined by determining dynamic forces.

15. The method as claimed in claim 14, wherein the rotational drive speed of the drum (12) is influenced on the basis of the determined unbalance of the loaded drum (12).

16. The method as claimed in claim 13, wherein driving is interrupted on the basis of an unbalance of the loaded drum (12), which unbalance is determined when said loaded drum is initially driven in rotation, when the determined unbalance of the loaded drum (12) reaches a prespecified limit value.

17. The method as claimed in claim 1, wherein the partial batches are formed by the unloading process being interrupted for a specific period of time after a specific amount of laundry containing the rest of the bound liquor is unloaded.

18. An apparatus for spin-drying laundry in a spin dryer (10) or laundry centrifuge, having a drum (12) which is driven in rotation and is mounted on a basic frame (18) which stands on the floor, wherein at least one weight sensor (20) is associated with the basic frame (18), wherein the laundry is washed and then spun-dry or only spun-dry in the drum (12) which is driven in rotation, the weight of at least of the contents of the drum (12) are determined using the at least one weight sensor (20, the weight of the laundry, together with remaining liquor which is still bound in the laundry, is determined using the at least one sensor (20) before and during unloading of the drum (12), and the weight of the laundry still remaining in the drum (12) together with the rest of the bound liquor, which weight is determined using the at least one sensor (20) during unloading of the drum (12), is used to form partial batches with a specific amount of laundry.

19. The apparatus as claimed in claim 18, wherein the at least one weight sensor (20)is arranged in the vicinity of a foot (19) which is used to support the basic frame (18) on the floor.

20. The apparatus as claimed in claim 19, wherein the basic frame (18) comprising the drum (12) is supported on the at least one weight sensor (20).

21. The apparatus as claimed in claim 19, wherein the at least one weight sensor (20) is arranged in the basic frame (18) in such a way that the weight sensor (20) which bears the basic frame (18) comprising the drum (12) is supported on the respective foot (19).

22. The apparatus as claimed in claim 19, wherein each foot (19) of the basic frame (18) has an associated weight sensor (20).

23. The apparatus as claimed in claim 18, wherein the basic frame (18) comprising the drum (12)is supported on the at least one weight sensor (20).

24. The apparatus as claimed in claim 18, wherein the at least one weight sensor (20) operates in a capacitive, inductive or piezoelectric manner, or in accordance with the strain gauge principle.

25. The apparatus as claimed in claim 18, wherein the at least one weight sensor (20) is in the form of a load cell, a force pickup cell or the like.

26. The apparatus as claimed in claim 18, wherein the partial batches are formed by the unloading process being interrupted for a specific period of time after a specific amount of laundry containing the rest of the bound liquor is unloaded.

* * * * *